US010711985B2

(12) United States Patent
Felt

(10) Patent No.: US 10,711,985 B2
(45) **Date of Patent: *Jul. 14, 2020**

(54) ENCLOSED GUTTER CLIP

(71) Applicant: Russel Williams Home Services LLC, Plymouth, MN (US)

(72) Inventor: David Russel Felt, Plymouth, MN (US)

(73) Assignee: Russel Williams Home Services LLC, Maple Plain, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/655,074

(22) Filed: Oct. 16, 2019

(65) Prior Publication Data

US 2020/0049331 A1 Feb. 13, 2020

Related U.S. Application Data

(63) Continuation of application No. 16/404,640, filed on May 6, 2019, which is a continuation-in-part of application No. 15/067,119, filed on Mar. 10, 2016, now Pat. No. 10,281,084.

(60) Provisional application No. 62/131,305, filed on Mar. 11, 2015.

(51) Int. Cl.
*F21V 21/088* (2006.01)
*F21W 121/00* (2006.01)

(52) U.S. Cl.
CPC ..... *F21V 21/088* (2013.01); *F21W 2121/004* (2013.01)

(58) Field of Classification Search
CPC ... F16M 13/022; F21V 33/006; F21V 21/088; F21V 21/0885; E04D 13/064
USPC ..... 248/200, 205.6, 229.16, 222.11, 222.12, 248/229.26, 316.7, 300; 362/391, 396, 362/249.01, 249.04, 152
See application file for complete search history.

(56) References Cited

U.S. PATENT DOCUMENTS 990,856 A * 5/1911 Freiberg ..... F16M 13/02 248/126
3,540,687 A * 11/1970 Cuva ..... F21V 19/0005 248/223.41
D365,014 S * 12/1995 Fennessy ..... D26/138
5,566,058 A * 10/1996 Protz, Jr. ..... F21V 21/08 362/249.09
5,581,956 A * 12/1996 Fennessy ..... F21V 21/088 248/237

(Continued)

*Primary Examiner* — Muhammad Ijaz
(74) *Attorney, Agent, or Firm* — Jordan One; Greenberg Traurig, LLP

(57) ABSTRACT

A decorative removable lighting enclosed clip made for mounting a light to a support surface such as gutters, shingles or a building structure. The enclosed clip allows for an aesthetically pleasing display of lights with rapid and easy installation and removal of the lighting. This eliminates falling debris from broken clips or clips that fall off the lights during the removal process. A support tab is inserted between the side portions of the structure, at longitudinally spaced intervals along the strip, and are frictionally gripped and retained by the facing side portions of the gutter, shingle or structure. The clips have enclosed end portions which support the light elements of a decorative light string along structure. The enclosed clip is capable of mounting onto a wide variety of gutters, eaves and building structures. The spacing is adjustable and provides a plurality of discrete angular positions.

15 Claims, 4 Drawing Sheets

(56) References Cited

U.S. PATENT DOCUMENTS

| | | | | |
|---|---|---|---|---|
| 5,607,230 | A * | 3/1997 | Protz, Jr. | F21V 21/08 248/229.16 |
| 5,921,511 | A * | 7/1999 | LaPointe | F21V 21/08 248/58 |
| 6,502,958 | B1 * | 1/2003 | Chen | F21V 21/088 362/249.14 |
| 6,536,727 | B1 * | 3/2003 | Limber | F16B 2/22 248/227.1 |
| 6,572,062 | B1 * | 6/2003 | Limber | F21V 21/088 248/227.1 |
| 8,459,712 | B2 * | 6/2013 | Thrasher | B25B 31/00 248/219.2 |
| 8,545,041 | B2 * | 10/2013 | Brown | A42B 1/24 24/336 |
| 8,888,337 | B2 * | 11/2014 | Adams, IV | F21S 4/10 362/396 |
| 2002/0186562 | A1 * | 12/2002 | Schroetter | F21V 21/088 362/249.01 |
| 2006/0152927 | A1 * | 7/2006 | Vendrick | F21V 21/088 362/249.01 |
| 2008/0135703 | A1 * | 6/2008 | Craig | A47B 96/061 248/229.16 |
| 2012/0241575 | A1 * | 9/2012 | Martinez Sanz | F24S 10/40 248/231.81 |

* cited by examiner

ENCLOSED GUTTER CLIP

CROSS-REFERENCE TO RELATED APPLICATIONS

This application is a continuation of U.S. patent application Ser. No. 16/404,640, filed May 6, 2019, which is a continuation-in-part of U.S. patent application Ser. No. 15/067,119, which was filed on Mar. 10, 2016 and issued on May 7, 2019 as U.S. Pat. No. 10,281,084, which claims priority to and the benefit of U.S. Provisional Patent Application No. 62/131,305, filed Mar. 11, 2015, the entireties of which are incorporated herein by reference.

FIELD OF THE DISCLOSURE

The present disclosure generally relates to clips and fasteners for maintaining decorations, such as holiday lights, on gutters, shingles, or other structures. Specifically, the present disclosure relates to clips and fasteners capable of being mated to a bulb or other decoration.

BACKGROUND

The present disclosure generally relates to attaching linear systems, decorative holiday lighting displays, ornamental light strings, misting systems, or the like to surfaces, such as gutters and other structural surfaces. Embodiments disclosed herein may be used for attaching strands of lights and the like on the exterior of homes, buildings or other structures using an enclosed gutter clip. Depending on the particular clip design, a bulb may be positioned at different angles with respect to a roofline, gutter or other support surface. Gutter clips are typically designed to accommodate a bulb of a particular size and shape (e.g., C7, C9, mini bulbs, and/or other bulb sizes).

SUMMARY

It has become increasingly popular to decorate the outside of buildings, homes and other structures with lights. These lights are generally arranged as a string of lights along a powered cord. Each individual light may be attached to a clip according to the present disclosure, which itself is adapted to mount to a gutter, shingle, or other structure. The clips of the present application may be designed to maintain a bulb at a particular angle and/or orientation, so as to provide a pleasing appearance. Lights are typically installed at a height that requires a ladder or lift. Installing the lights onto the gutters is very time consuming because the installer must move a ladder or lift as they install the lights across a building or structure.

A bulb is inserted thru the front of our enclosed gutter clip and screwed into the power socket from behind. It is then attached to the gutter without the use of staples, nails or any other type of fastener on the exteriors of homes, buildings or other structures while permitting bulbs to be angularly oriented with respect to the roofline at predetermined intervals at selected annular positions.

The enclosed gutter clip allows quick and efficient removal of the lights and clips simultaneously without causing any damage to the gutter line, roofline, structure or lights. By using an enclosed gutter clip you are able to remove the light strand in most instances without the use of a ladder or lift avoiding leaving behind broken gutter clips in the gutters themselves, on the roofline or on the ground.

The invention consists of certain novel features and a combination of parts hereinafter fully described, illustrated in the accompanying drawings and particularly pointed out in the appended claims, it being understood that various changes in the details may be made without departing from the spirit, or sacrificing any of the advantages of the present invention.

In an aspect of the present application, a clip includes an elongated body, a strut, a cantilever, a substantially circular bulb holder, and a neck. The elongated body has a first end and a second end. The strut has a first end and a second end, with the first end of the strut being rigidly connected to the second end of the elongated body. The first end of the strut and the second end of the strut collectively define a strut axis. The cantilever has a first end and a second end, with the first end of the cantilever being rigidly connected to the second end of the strut. The substantially circular bulb holder rigidly connects to and extends from the first end of the cantilever in a direction substantially opposite the second end of the cantilever. The bulb holder includes a hole configured to receive at least a portion of a bulb. The hole has a central axis extending therethrough that is substantially parallel to the strut axis. The neck is situated between and rigidly connects the cantilever and the bulb holder. The second end of the cantilever is resiliently capable of being pulled away from the elongated body to accommodate the positioning of a structure between elongated body and the cantilever. The clip is may be made from a substantially resilient material having a memory that causes the second end of the cantilever to return toward a relaxed position when not subject to an external force. When the structure is situated between the elongated body and the cantilever, the memory causes the second end of the cantilever to return toward the relaxed position, such that the cantilever and the elongated body exert pressure on the structure, to thereby maintain the position of the clip about the structure.

The foregoing summary is illustrative only and is not intended to be in any way limiting. In addition to the illustrative aspects, embodiments, and features described above, further aspects, embodiments and features will become apparent by reference to the drawing figures, the following detailed description, and the claims.

BRIEF DESCRIPTION OF THE DRAWINGS

To assist in understanding the disclosure, and to show how embodiments of the present application may be implemented, there will now be described by way of example specific embodiments, apparatuses, systems, and methods with reference to the accompanying drawings, in which.

DETAILED DESCRIPTION OF THE EMBODIMENTS

There will now be described, by way of example, several embodiments of the present application as contemplated by the inventor. In the following description, specific details are set forth in order to provide a thorough understanding of the embodiments. It will be apparent, however, that the embodiments of the present disclosure may be practiced without limitation to these specific details. The specific embodiments disclosed herein are not intended to limit the scope of the present application.

Figure 1:
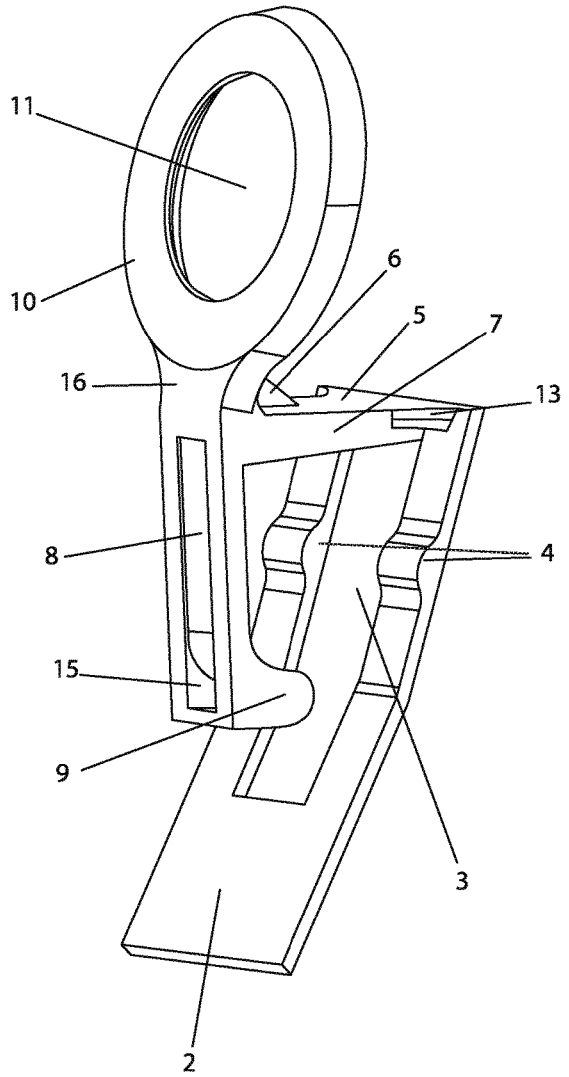
FIG. 1 is a front perspective view of an example gutter clip, according to an embodiment of the present application.

The present invention shown in FIG. 1 is an enclosed gutter clip 1 having a hollowed rectangular shaped body 2. This body 2 has a slight protrusion 4 that secures body 2 on the structure, providing counter pressure on the body 2 portion side of the clip 1, and opposing pressure on strut 7, cantilever 8, and lobe 9. The protrusions 4 are not required but are useful in providing stability for the function of the clip 1; they provide extra structure to ensure the clip 1 is secure at a 90° angle. Bracket 5 and strut 7 connect to cantilever 8 perpendicularly, forming a 90° angle between cantilever 8, side 5, strut 7 and a 75° angle between body 2 and strut 7, bracket 5. The clip 1 as shown in FIG. 1 is how the clip will generally (but not always) be positioned vertically on the outer edge of a structure. Cantilever 8 is on the outside of a structure or the top of a shingle and body 2 provides pressure on the opposite side of the gutter edge or shingle.

Figure 2:
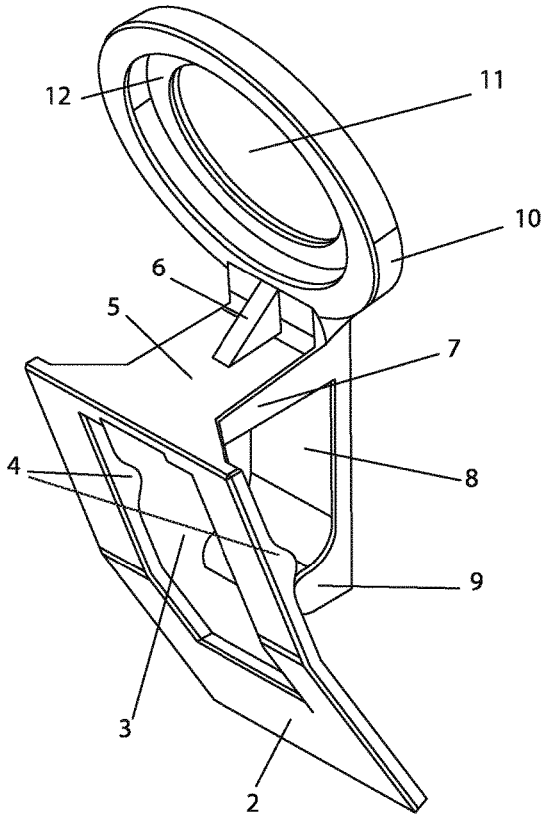
FIG. 2 is a rear perspective view of the example gutter clip, according to an embodiment of the present application.

The clip 1 is designed so that the protrusion 4 and cantilever 8 provide pressure on opposite sides of the gutter with the weight of the clip resting on top of the gutter edge on bracket 5. The body 2 below protrusion 4 provides extra pressure and stability for the clip 1. The bulb will be inserted through hole 11 on the front part of the outer flange 10 and screwed into the light socket that will be on the back side of the clip and within the socket guide ridge 12 (see FIG. 2). Outer flange 10 is supported by neck gusset 6 so that it is ridged and does not flex or move. Strut gusset 13 is to provide stability to the body 2 as it provides pressure against the surface opposition of cantilever 8. Socket guide ridge 12 could increase in thickness if preferred. The body 2 is designed to be longer than strut 7 for quicker installation on gutters, eaves or other structures. This area can be lengthened or shortened to accommodate size variances if needed. The neck 16 can be adjusted with neck gusset 6 if desired.

Hole 3 and opening 15 are unessential to the performance or functionality of the invention and are solely used for efficiency in the production of the clip. Opening 15 is to thin out cantilever 8 for the purpose of using less plastic and also to prevent clotting of the plastic as it flows through the dye tool. Strut 7 is indented on the bottom side of bracket 5 to reduce plastic and also to prevent clotting as the plastic flows through the dye tool. Hole 3 reduces plastic needed to create the clip and also allows the dye tool to move through hole 3 to create cantilever 8 with ease.

In order to place the clip 1 on the gutter, eaves or other structure, position the clip below the structure and push upward causing the ends to flex apart. Another way of attaching the clip 1 is to tilt the clip shown in FIG. 2 at an angle such that body 2 engages the structure and apply pressure.

One advantage of the present clip is that the clip 1 can flex to some extent to accommodate the gutter, eaves or structure. The present preferred clip has a standard distance 14 (see FIG. 4) of approximately ⅛ inch between body 2 and lobe 9 when clip 1 is attached to a gutter, eaves or other structure and is in a relaxed condition. The opposing ends of clip 1, i.e., body 2, cantilever 8 and lobe 9, can be pulled apart such that the distance 14 would be as much as 2 inches to accommodate the width of the gutter, eaves or shingles. Thus, the present clip can be fitted over structures from approximately ⅛ inch to 2 inches. When placed on a gutter, eaves, shingles or other structure, the protrusions 4 provide optional support in holding clip 1 in place.

The present clip is designed primarily for use on the eaves, gutters or shingles of a house; but, its use is not so limited.

Although I have described and illustrated certain present preferred embodiments of my clip it should be distinctly understood that the invention is not limited thereto, but may be variously embodied within the scope of the following claims.

Figure 3:
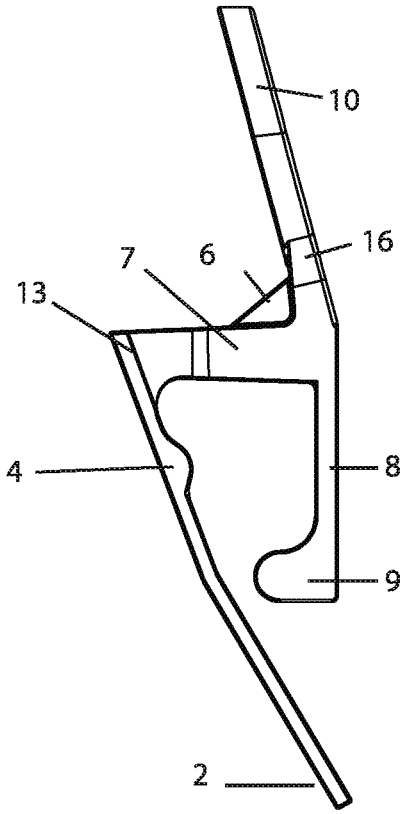
FIG. 3 is a side elevated view of the example gutter clip, according to an embodiment of the present application.
Figure 4:
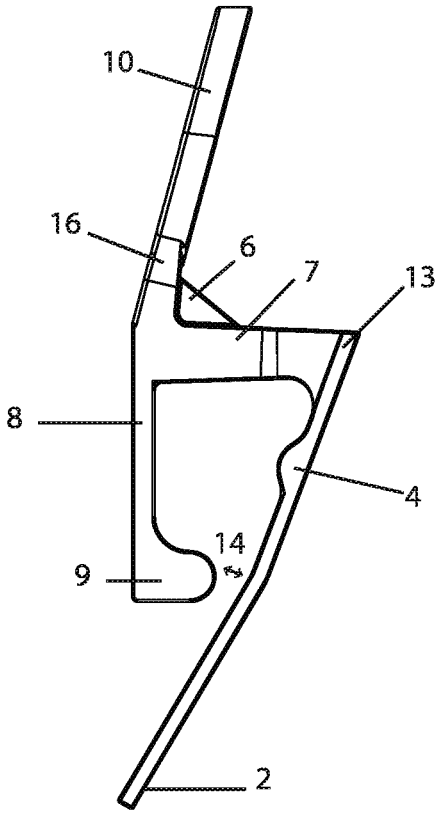
FIG. 4 is a side elevated view of the example gutter clip, according to an embodiment of the present application.
Figure 5:
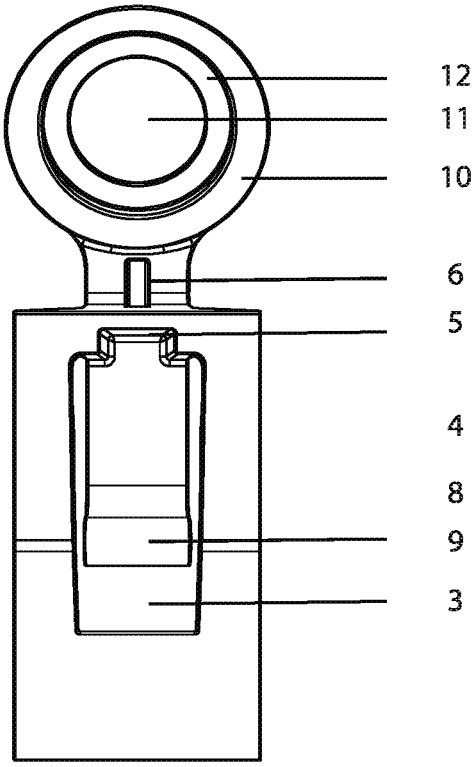
FIG. 5 is a rear elevated view of the example gutter clip, according to an embodiment of the present application.
Figure 6:
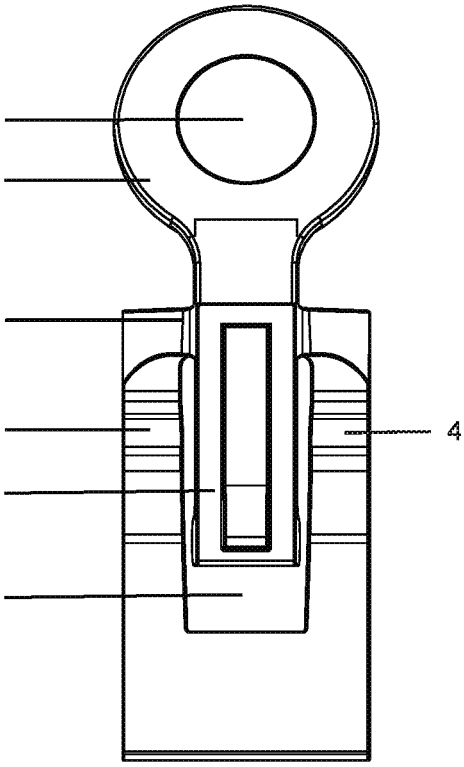
FIG. 6 is a front elevated view of the example gutter clip, according to an embodiment of the present application.
Figure 7:
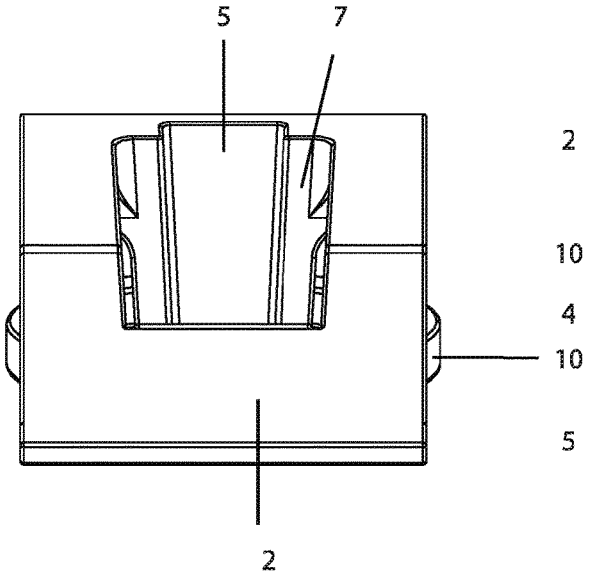
FIG. 7 is a bottom plan view of the example gutter clip, according to an embodiment of the present application.
Figure 8:
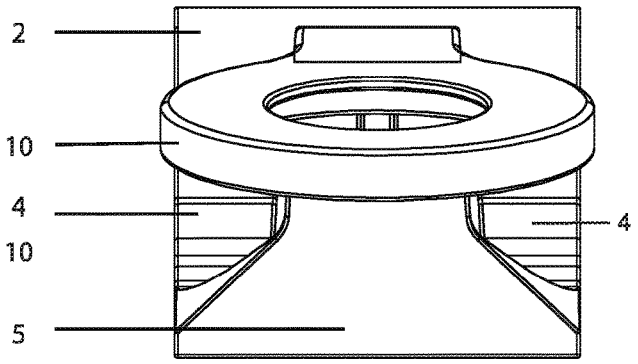
FIG. 8 is a top plan view of the example gutter clip, according to an embodiment of the present application.

Cables, wires, strands and alternate objects could rest on FIG. 3 and FIG. 4, bracket 5 and outer flange 10 to prevent it from falling.

The bulb holder section includes the outer flange 10 and a hole 11 which can vary in size based on the size of the bulb.

Referring to FIG. 1, the clip 1 may be formed from a synthetic resin and it is a one piece construction. The clip 1 is made from a resin which may be an acrylic, a polycarbonate, a nylon, a polyethylene or polypropylene or mixtures thereof. The resin material is made to withstand cold temperatures to eliminate breaking clips.

FIGS. 1-8 illustrate various views of a clip 1 according to an embodiment of the present application. The clip 1 includes an elongated body 2, a strut 7, a cantilever 8, and a bulb holder collectively formed from outer flange 10, hole 11, and socket guide ridge 12. The strut 7 extends between and rigidly couples the body 2 and the cantilever 8, such that the body 2, the strut, and the cantilever (which may be referred to referred to herein as a "gripping section" or "attachment section") form a substantially "U-shaped" or "C-shaped" structure.

In some implementations, such as the embodiment depicted in FIGS. 1-8, the angles between the body 2 and the strut, and between the strut and the cantilever 8 may be less than 180 degrees, such that the end of the cantilever 8 opposite to its point of attachment with the strut converges toward the body 2. In these implementations, the cantilever 8 may be movable with respect to the body 2 to accommodate the positioning of a gutter, shingle, or other structure in between the cantilever 8 and the body 2. When installed onto a gutter, shingle, or other structure, the cantilever 8 applies a force toward the body 2, which serves to hold the clip 1 firmly in place.

In some embodiments, the cantilever 8 includes a lobe 9 extending toward the body 2. Additionally, and/or alternatively, the body 2 may include one or more protrusions 4 extending toward the cantilever 8. The lobe 9 and/or the one or more protrusions 4 may increase the effective gripping force between the cantilever 8 and the body 2 when positioned about a structure. The shapes and sizes of the lobe 9 and the one or more protrusions 4 may vary, depending on a desired amount of gripping force, the particular structure about which the clip 1 is designed to attach, and/or various other factors.

The clip 1 also includes a substantially circular bulb holder, which is formed from an outer flange 10, a socket guide ridge 12, and a hole 11 having a resting diameter 19. The bulb holder is adapted to receive a bulb (e.g., a C7 or C9 bulb) oriented with its major axis (e.g., the axis extending from the front tip of the bulb through the electrical contacts at the rear end of the bulb) extending through the hole 11.

The clip 1 may further include neck 16. The neck 16 may be a portion of material that extends between the outer flange 10 and the socket guide ridge 12 of the bulb holder and the cantilever 8 and/or the strut 7. In addition, the clip 1 may include one more triangularly-shaped gussets or reinforcement structures at various locations along the clip (e.g., between the strut 7 and the neck sections 8, and/or between the strut sections 7 and the body 2), which may strengthen particular aspects of the clip 1.

Some optional aspects of the clip 1 are shown in FIGS. 1-10, which may be included or excluded depending on the particular implementation. An opening 15 may be included toward the end of the cantilever 8 near the lobe 9, which may reduce the amount of material used in constructing the clip 1, and/or may reduce the likelihood of the material clotting as it flows through a die tool. In some use cases, a hinge 18 may be included in clip 1, which may be foldable along the crease between the body 2 and the hinge 18. The hinge 18 may be used to assist in mounting the clip 1 to certain structures, such as shingles.

The clips according to the present disclosure may be formed from a synthetic resin, and may be integrally formed as a one-piece construction. The clips may be made from a resin which may be an acrylic, a polycarbonate, a nylon, a polyethylene or polypropylene or mixtures thereof. The resin material used to construct the clips of the present disclosure may be able to withstand cold temperatures to reduce the chance that the clips breaks.

Regardless of the specific material used to construct the clips of the present disclosure, the material may be "resilient," flexible, or exhibit elastic qualities. As described herein, a "resilient material" may refer to a material that is able to be deformed, at least to some extent, when subjected to a force, and returns to an original form factor when not subjected to an external force. A structure formed from a resilient material may have a "memory" of its resting or relaxed state, in that the structure may resist deformation, bending, or stretching with a tendency to return to its relaxed state. In addition, aspects of a clip described as "rigidly coupled" herein may refer to a rigid connection between structural elements formed from a resilient material, such that the rigid connection permits some amount of flexibility and/or deformation.

Although certain example methods and apparatus have been described herein, the scope of coverage of this patent is not limited thereto. On the contrary, this patent covers all methods, apparatuses, and articles of manufacture fairly falling within the scope of the appended claims, either literally or under the doctrine of equivalents. Accordingly, this patent specification is intended to embrace all alternatives, modifications and variations of the present invention that have been discussed herein, and other embodiments that fall within the spirit and scope of the above described invention.

It should be understood that arrangements described herein are for purposes of example only. As such, those skilled in the art will appreciate that other arrangements and other elements (e.g. machines, interfaces, operations, orders, and groupings of operations, etc.) can be used instead, and that some elements may be omitted altogether, according to the desired results. Further, many of the elements that are described are functional entities that may be implemented as discrete or distributed components or in conjunction with other components, in any suitable combination and location, or as other structural elements described as independent structures may be combined.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. It is also to be understood that the terminology used herein is for the purpose of describing particular implementations only, and is not intended to be limiting.

What is claimed is:

1. A clip comprising:

an elongated body having a first end and a second end;

a strut having a first end and a second end, wherein the first end of the strut is rigidly connected to the second end of the elongated body, and wherein the first end of the strut and the second end of the strut collectively define a strut axis;

a cantilever having a first end and a second end, wherein the first end of the cantilever is rigidly connected to the second end of the strut;

a substantially circular bulb holder rigidly connected to and extending from the first end of the cantilever in a direction substantially opposite the second end of the cantilever, wherein the bulb holder includes a hole configured to receive at least a portion of a bulb, wherein the hole has central axis extending therethrough that is substantially parallel to the strut axis; and a neck situated between and rigidly connecting the cantilever and the bulb holder, wherein the second end of the cantilever is resiliently capable of being pulled away from the elongated body to accommodate a positioning of a structure between the elongated body and the cantilever, and the clip is made from a substantially resilient material having a memory that causes the second end of the cantilever to return toward a relaxed position when not subject to an external force, and wherein, when the structure is situated between the elongated body and the cantilever, the memory causes the second end of the cantilever to return toward the relaxed position, such that the cantilever and the elongated body exert pressure on the structure, to thereby maintain a position of the clip about the structure.

2. The clip of claim 1, wherein the bulb holder has a front side and a back side, and wherein the bulb holder further comprises:

an annular outer flange on the front side of the bulb holder having an inner radius and an outer radius, wherein the annular outer flange is continuous, and wherein the hole is within the inner radius of the annular outer flange; and a socket guide ridge on the back side of the bulb holder having an inner radius and an outer radius, wherein the inner radius of the annular outer flange and the inner radius of the socket guide ridge are aligned, wherein a radius of the socket guide ridge is less than a radius of the annular outer flange, and wherein the hole is configured to receive a threaded end of the bulb and the socket guide ridge is configured to abut a bulb socket such that, when the threaded end of the bulb is screwed into the bulb socket, the bulb holder securely supports the bulb.

3. The clip of claim 1, wherein the cantilever comprises a lobe extending from the second end of the cantilever toward the elongated body.

4. The clip of claim 1, wherein the structure is a gutter.

5. The clip of claim 1, wherein the structure is an eave.

6. The clip of claim 1, wherein the structure is a shingle.

7. The clip of claim 1, wherein a distance between the second end of the cantilever and the elongated body is approximately ⅛ inch when the cantilever is in the relaxed position.

8. The clip of claim 7, wherein the second end of the cantilever is capable of being pulled away from the elongated body such that the distance between the second end of the cantilever and the elongated body is approximately 2 inches.

9. The clip of claim 1, wherein the bulb is a C9 bulb.

10. The clip of claim 1, wherein the bulb is a C7 bulb.

11. The clip of claim 1, wherein the substantially resilient material is a synthetic resin material.

12. The clip of claim 11, wherein the synthetic resin material comprises one or more of an acrylic, a polycarbonate, a nylon, a polyethylene, and a polypropylene.

13. The clip of claim 1, wherein the clip is integrally formed as a one piece construction.

14. The clip of claim 1, wherein the clip further comprises at least one strut gusset rigidly connected to the strut and the elongated body.

15. The clip of claim 1, wherein the clip further comprises a neck gusset rigidly connected to the strut and the bulb holder.

* * * * *